US007106354B2

(12) United States Patent
Sato et al.

(10) Patent No.: US 7,106,354 B2
(45) Date of Patent: Sep. 12, 2006

(54) PRINTER APPARATUS

(75) Inventors: Yoshinori Sato, Chiba (JP); Norimitsu Sanbongi, Chiba (JP); Minoru Hoshino, Chiba (JP); Tatsuya Obuchi, Chiba (JP)

(73) Assignee: Seiko Instruments Inc., (JP)

( * ) Notice: Subject to any disclaimer, the term of this patent is extended or adjusted under 35 U.S.C. 154(b) by 15 days.

(21) Appl. No.: 10/844,289

(22) Filed: May 12, 2004

(65) Prior Publication Data

US 2004/0257428 A1 Dec. 23, 2004

(30) Foreign Application Priority Data

Jun. 9, 2003 (JP) ..... 2003-164192

(51) Int. Cl.
*B41J 2/315* (2006.01)

(52) U.S. Cl. ..... 347/171

(58) Field of Classification Search ..... 347/171, 347/200, 202, 212, 218, 220, 221, 223; 400/120.01
See application file for complete search history.

(56) References Cited

U.S. PATENT DOCUMENTS 5,583,664 A 12/1996 Sanpei ..... 358/498
5,961,234 A 10/1999 Uchikata ..... 400/636

FOREIGN PATENT DOCUMENTS

EP 1088672 4/2001

OTHER PUBLICATIONS

Patent Abstract of Japan, vol. 1999, No. 08, Jun. 30, 1999, publication No. 11079152, publication date Mar. 23, 1999.
Patent Abstract of Japan, vol. 1996, No. 08, Aug. 30, 1996, publication No. 08108941, publication date Apr. 30, 1996.
Patent Abstract of Japan, vol. 2000, No. 15, Apr. 6, 2001, publication No. 2000335801, publication date Dec. 5, 2000.
Patent Abstracts of Japan, vol. 0163, No. 28 (M-1281), publication No. 04094344, publication date Mar. 26, 1992.
Patent Abstracts of Japan, vol. 1996, No. 04, publication No. 07334024, publication date Dec. 22, 1995.
Patent Abstracts of Japan, vol. 1996, No. 05, publication No. 08012126, publication date Jan. 16, 1996.

*Primary Examiner*—K. Feggins
(74) *Attorney, Agent, or Firm*—Adams & Wilks

(57) ABSTRACT

A printer apparatus has a thermal head for printing by making contact with a heat-sensitive coloring layer of a heat-sensitive adhesive sheet comprised of the heat-sensitive coloring layer and a heat-sensitive adhesive layer formed on opposite sides of a sheet-like base material. A thermal head heats the heat-sensitive adhesive layer to activate the same, and a conveying roller conveys the heat-sensitive adhesive sheet in a predetermined direction to an ejection hole which ejects the heat-sensitive adhesive sheet out of the apparatus. A sheet holding unit holds the printed sheet with part of the same exposed to the outside from the ejection hole.

24 Claims, 11 Drawing Sheets

PRINTER APPARATUS

BACKGROUND OF THE INVENTION

1. Field of the Invention

The present invention relates to a printer apparatus for a heat-sensitive adhesive sheet having a heat-sensitive adhesive layer, which normally exhibits non-adhesive properties and exhibits adhesive properties when heated, formed on one side of a sheet-like base material and, more particularly, to a printer apparatus capable of holding a heat-sensitive adhesive sheet which has been subjected to a printing process and a thermal activation process in a state in which it can be easily picked up.

2. Description of the Related Art

One type of sheets applied to commodities recently is thermally activated sheets (e.g., printed media such as heat-sensitive adhesive sheets that are formed with a coat layer including a thermally activated component on a surface thereof) which are used in a wide range of fields, e.g., POS sheets for food products, distribution/delivery sheets, sheets for medical use, baggage tags, and indication sheets applied to bottles and cans.

Such a heat-sensitive adhesive sheet is configured by forming a heat-sensitive adhesive layer that normally exhibits non-adhesive properties and exhibits adhesive properties when heated and a printable surface on a bottom side and a top side of a sheet-like base material (e.g., base paper), respectively.

The heat-sensitive adhesive is mainly composed of a thermoplastic resin, a solid plasticizing agent, or the like, and it is characterized in that it is non-adhesive at the room temperature and is activated to exhibit adhesive properties when heated by a thermal activation apparatus. Normally, the activating temperature is 50 to 150° C., and the solid plasticizing agent in the heat-sensitive adhesive is melted to impart adhesive properties to the thermoplastic resin. Since the melted solid plasticizing agent is gradually crystallized after undergoing an overcooled state, the adhesive properties are maintained for a predetermined time. The sheet is used by applying it to a surface of an object such as a glass bottle while it has the adhesive properties.

Printer apparatus utilizing such heat-sensitive adhesive sheets include that proposed in "a method and apparatus for thermally activating a heat-sensitive adhesive label and a printer" disclosed in Patent Document 1 (Japanese Patent Laid-Open No. JP-A-11-79152).

With the printer apparatus, desired characters, images, and so on are printed on a printable surface of a heat-sensitive adhesive sheet by a thermal printer apparatus having a thermal head, and the heat-sensitive adhesive layer can be activated by the thermal activation apparatus after the printing.

An operation of applying an indication sheet to a glass bottle such as a bottle for liquor or medicine, a plastic container, or the like or an operation of applying a price tag or an advertising sheet may be performed after the adhesive capability of the heat-sensitive adhesive sheet is thus exhibited. Since this eliminates a need for a release sheet (liner) as that used in a common conventional adhesive label sheet, there is an advantage in that a cost reduction can be achieved. Further, since there is no need for a release sheet which becomes a waste after being used, there is merit also from the viewpoint of resource-saving and environmental problems.

However, the conventional printer apparatus has no means for holding a heat-sensitive adhesive sheet which has been subjected to a thermal activation process.

Therefore, a user of the printer apparatus may not be able to apply a heat-sensitive adhesive sheet because it drops when ejected from the printer apparatus unless the user waits for the heat-sensitive adhesive sheet to pick it up as soon as it is ejected, which has resulted in the problem of insufficient convenience and operability.

When a heat-sensitive adhesive sheet remains in the vicinity of the ejection hole of the printer apparatus after ejection, since the heat-sensitive adhesive layer cools down and solidifies again as time (e.g., several tens seconds) passes, a problem has arisen in that the heat-sensitive adhesive sheet firmly adheres to the neighborhood of the ejection hole to become unusable and in that it necessitates a troublesome cleaning operation such as peeling the sheet away.

In particular, since a heat-sensitive adhesive sheet which has been subjected to the thermal activation process in the above-described conventional printer apparatus is simply sent out by conveying means (platen roller) provided at the thermal activation device, a problem arises in that part of the heat-sensitive adhesive layer adheres to the thermal head when the conveyance with the platen roller is stopped with the trailing end of the heat-sensitive adhesive sheet remaining on the thermal head. When the heat-sensitive adhesive adheres to a surface of the thermal head for thermal activation, problems arise when a subsequent heat-sensitive adhesive sheet comes, the problems including transfer of the adhesive to the heat-sensitive adhesive layer of the subsequent heat-sensitive adhesive sheet which can smear or damage the layer or reduce the flatness of the adherend. The deposited adhesive can be altered and burned when it is kept heated by the thermal head, which has resulted in the possibility of reduction in the heating performance of the thermal head to disable sufficient thermal activation.

SUMMARY OF THE INVENTION

The invention has been conceived to solve the above-described problems, and it is an object of the invention to provide a printer apparatus capable of holding a heat-sensitive adhesive sheet in a state in which it can be easily picked up after being subjected to a printing process and a thermal activation process and preventing the adhesive from adhering to a thermal head for thermal activation.

In order to achieve the object, the present invention is a printer apparatus having at least a thermal head for printing (a thermal head 32 for printing) which performs printing in contact with a heat-sensitive coloring layer of a heat-sensitive adhesive sheet (a heat-sensitive adhesive label L) having a printable surface constituted by the heat-sensitive coloring layer and a heat-sensitive adhesive layer formed on one and another side of a sheet-like base material, respectively, a thermal head for activation (a thermal head 52 for thermal activation) which heats the heat-sensitive adhesive layer to activate the same, conveying means (a conveying roller 61 or the like) which conveys the heat-sensitive adhesive sheet in a predetermined direction, and an ejection hole for ejecting the heat-sensitive adhesive sheet out of the apparatus, and it has sheet holding means (a label holding unit 70) which spaces a trailing end of the heat-sensitive adhesive sheet which has been subjected to the printing process by the thermal head for printing and the activation process by the thermal head for activation from the thermal head for activation and which holds the sheet with part of the same exposed to the outside from the ejection hole.

Since this allows a user to perform an applying operation by picking up the heat-sensitive adhesive sheet held by the sheet holding means at desired timing, convenience and user-friendliness can be improved because there is no operational restrictions such as picking up an ejected heat-sensitive adhesive sheet as soon as it arrives as in the prior art.

Since a sheet can be held with the trailing end of the same spaced from the thermal head for thermal activation, it is possible to avoid the problem of adhesion of part of the heat-sensitive adhesive on to the thermal head. It is therefore possible to prevent the problem of smear or damage on the heat-sensitive adhesive layer of a subsequent heat-sensitive adhesive sheet because of transfer of the adhesive that occurs when the heat-sensitive adhesive adheres to the surface of the thermal head for thermal activation and the problem of reduction in the heating performance of the thermal head because of alteration and burning of the adhesive that has adhered.

The sheet holding means comprises a first rotating body (a wheel-like roller member 101 or the like) which is driven for rotation in the conveying direction with a circumferential surface thereof in contact with the heat-sensitive adhesive layer, a contact member (a roller member 105 or the like) which is provided opposite to the circumferential surface of the rotating body with a gap equal to or smaller than the thickness of the heat-sensitive adhesive sheet left therebetween, driving means (a second stepping motor 711 or the like) for the rotating body, and control means (a CPU 700 or the like) for the driving means. The control means may control the driving means such that the heat-sensitive adhesive sheet conveyed through the thermal head for activation is sandwiched between the circumferential surface of the rotating body and the contact member and conveyed a predetermined distance with the conveying means so as to space the trailing end of the sheet from the thermal head for activation and such that the rotation of the rotating body is stopped with part of the sheet exposed to the outside from the ejection hole.

It is therefore possible to provide sheet holding means with a simple configuration for spacing the trailing end of the heat-sensitive adhesive sheet from the thermal head for activation and holding the sheet with part of the same exposed to the outside from the ejection hole.

The contact member may comprise a second rotating body which is disposed in the width direction of the heat-sensitive adhesive sheet and which contacts the printable surface. This allows the heat-sensitive adhesive sheet to be reliably conveyed and held by the first rotating body and the second rotating body.

The first and second rotating bodies may comprise a plurality of rollers securely provided at predetermined intervals in the axial direction of rotating shafts which can rotate in the conveying direction. This makes it possible to reduce the area in which the first rotating body contacts the heat-sensitive adhesive layer while maintaining reliable conveyance and retention of the heat-sensitive adhesive sheet and to avoid transfer of the adhesive with higher reliability.

The first rotating body may comprise a wheel-like roller. This allows a further reduction of the area in which the first rotating body contacts the heat-sensitive adhesive layer and allows the transfer of the adhesive to be more reliably avoided.

The first rotating body may be configured by providing two or more rotating shafts, which can rotate in the conveying direction, side by side perpendicularly to the conveying direction and securely providing a plurality of wheel-like rollers at predetermined intervals in the axial direction of each of the rotating shafts, and at least one of the rotating shafts may be configured such that a driving force is transmitted thereto by the driving means. Thus, the heat-sensitive adhesive sheet is sandwiched by the contact member and the plurality of rollers provided side by side in the conveying direction, and conveyance and retention can be more reliably performed.

The first rotating body may be configured by providing two or more rotating shafts, which can rotate in the conveying direction, side by side perpendicularly to the conveying direction, securely providing a plurality of wheel-like rollers at predetermined intervals in the axial direction of each of the rotating shafts, and winding an endless belt around each of the series of rollers arranged in the conveying direction, and at least one of the rotating shafts may be configured such that a driving force is transmitted thereto by the driving means. Thus, the heat-sensitive adhesive sheet is sandwiched by the contact member and the endless belts having a contact portion which is relatively long in the conveying direction, and conveyance and retention can be more reliably performed.

The first and second rotating bodies may be alternately disposed such that their circumferential surfaces do not face each other. Thus, since the circumferential surface of the first rotating body and the circumferential surface of the second rotating body do not contact each other when no heat-sensitive adhesive sheet is held by the holding means, transfer of the adhesive to the second rotating body is prevented even if the adhesive has adhered to the circumferential surface of the first rotating body. It is therefore possible to prevent situations in which the printable surface of the heat-sensitive adhesive sheet is smeared or damaged as a result of transfer of the adhesive through the second rotating body.

A configuration may be employed in which the distance between the rotating shaft of the first rotating body and the rotating shaft of the second rotating body is equal to or smaller than the sum of the radius of the first rotating body and the radius of the second rotating body. Thus, an adequate pressure can be applied to the heat-sensitive adhesive sheet when it is sandwiched between the first rotating body and the second rotating body, and the sheet can be more reliably conveyed and held because of the viscosity and frictional force of the same.

The contact member may comprise a plate-like member provided such that it extends in the width direction of the heat-sensitive adhesive sheet. This allows the holding means to be formed in a simpler configuration.

The contact member may comprise a member in the form of a plate spring provided such that it extends in the width direction of the heat-sensitive adhesive sheet. Thus, an adequate pressure can be applied to the heat-sensitive adhesive sheet with a simple configuration, and conveyance and retention can be reliably performed.

The contact member may be formed with comb-like grooves having a width greater than the width of the rotating body in the longitudinal direction. The first rotating body may be provided such that it is interposed in each of the comb-like grooves. A configuration may be employed in which the distance between the rotating shaft of the first rotating body and a surface of the contact member opposite thereto is equal to or smaller than the length of the radius of the first rotating body. Thus, since an outer surface of the contact member and the circumferential surface of the first rotating body do not contact each other when no heat-sensitive adhesive sheet is held by the holding means, transfer of the adhesive to the contact member is prevented even if the adhesive has adhered to the circumferential surface of the first rotating body. It is therefore possible to prevent situations in which the printable surface of the heat-sensitive adhesive sheet is smeared or damaged as a result of transfer of the adhesive through the contact member.

The roller may be formed of a material which is mainly composed of a substance having a relatively low surface energy such as a silicone resin or fluororesin. This makes it possible to reliably prevent the adhesive from adhering to a surface of the roller from the heat-sensitive adhesive layer of the heat-sensitive adhesive sheet.

The roller may comprise an O-ring attached to a circumferential surface thereof, the O-ring being formed of a material which is mainly composed of a substance having a relatively low surface energy such as a silicone resin or fluororesin. This makes it possible to reliably prevent the adhesive from adhering to a surface of the O-ring that constitutes a circumferential surface of the roller from the heat-sensitive adhesive layer of the heat-sensitive adhesive sheet.

The endless belt may be formed of a material which is mainly composed of a substance having a relatively low surface energy such as a silicone resin or fluororesin. This makes it possible to reliably prevent the adhesive from adhering to a surface of the endless belt from the heat-sensitive adhesive layer of the heat-sensitive adhesive sheet.

A plurality of protrusions may be formed on a circumferential surface of the first rotating body. This makes it possible to reduce the area in which the heat-sensitive adhesive layer of the heat-sensitive adhesive sheet and the first rotating body contact each other and to reliably prevent the adhesive from adhering to the circumferential surface of the first rotating body.

The protrusions may be formed such that the first rotating body has a star-like or gearwheel-like sectional shape. Thus, the heat-sensitive adhesive layer of the heat-sensitive adhesive sheet and the first rotating body can be put in linear contact with each other to reduce the contact area and to reliably prevent the adhesive from adhering to the circumferential surface of the first rotating body. When the second rotating body is similarly formed such that it has a star-like or gearwheel-like sectional shape, the heat-sensitive adhesive sheet can be sandwiched between the first rotating body and itself to allow reliable conveyance and retention.

When the member put in contact with the heat-sensitive adhesive layer is a comb-like member and is formed such that it can convey and hold the heat-sensitive adhesive sheet each time the rotating body provided opposite thereto is driven for rotation in the conveying direction, a leading end face of the comb-like contact member may be formed of a material which is mainly composed of a substance having a relatively low surface energy such as a silicone resin or fluororesin. Since this results in a low frictional coefficient and a small contact area, there is a small frictional force which allows conveyance and retention to be performed by the opposite rotating body.

Detection means which detects the presence or absence of the heat-sensitive adhesive sheet may be further provided in the vicinity of the ejection hole, and control may be performed such that the driving of the driving means is resumed to eject the heat-sensitive adhesive sheet out of the apparatus entirely when a detection signal from the detection means continues for a predetermined time. As a result, since the entire heat-sensitive adhesive sheet is ejected out of the apparatus when retention continues for the predetermined time (which is several tens seconds, for example), it is possible to automatically abandon the heat-sensitive adhesive sheet which has become unusable because the heat-sensitive adhesive layer has cooled down and lost adhesion.

Furthermore, detection means which detects the presence or absence of the heat-sensitive adhesive sheet may be further provided in the vicinity of the ejection hole, and control may be performed to reverse the driving means and to reactivate the heat-sensitive adhesive layer with the thermal head for activation when a detection signal from the detection means continues for a predetermined time. As a result, the heat-sensitive adhesive layer of the heat-sensitive adhesive sheet can be automatically reactivated to restore adhesion when retention continues for the predetermined time (which is several tens seconds, for example).

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERRED EMBODIMENT

Preferred embodiments of the invention will now be described based on the drawings.

Figure 1:
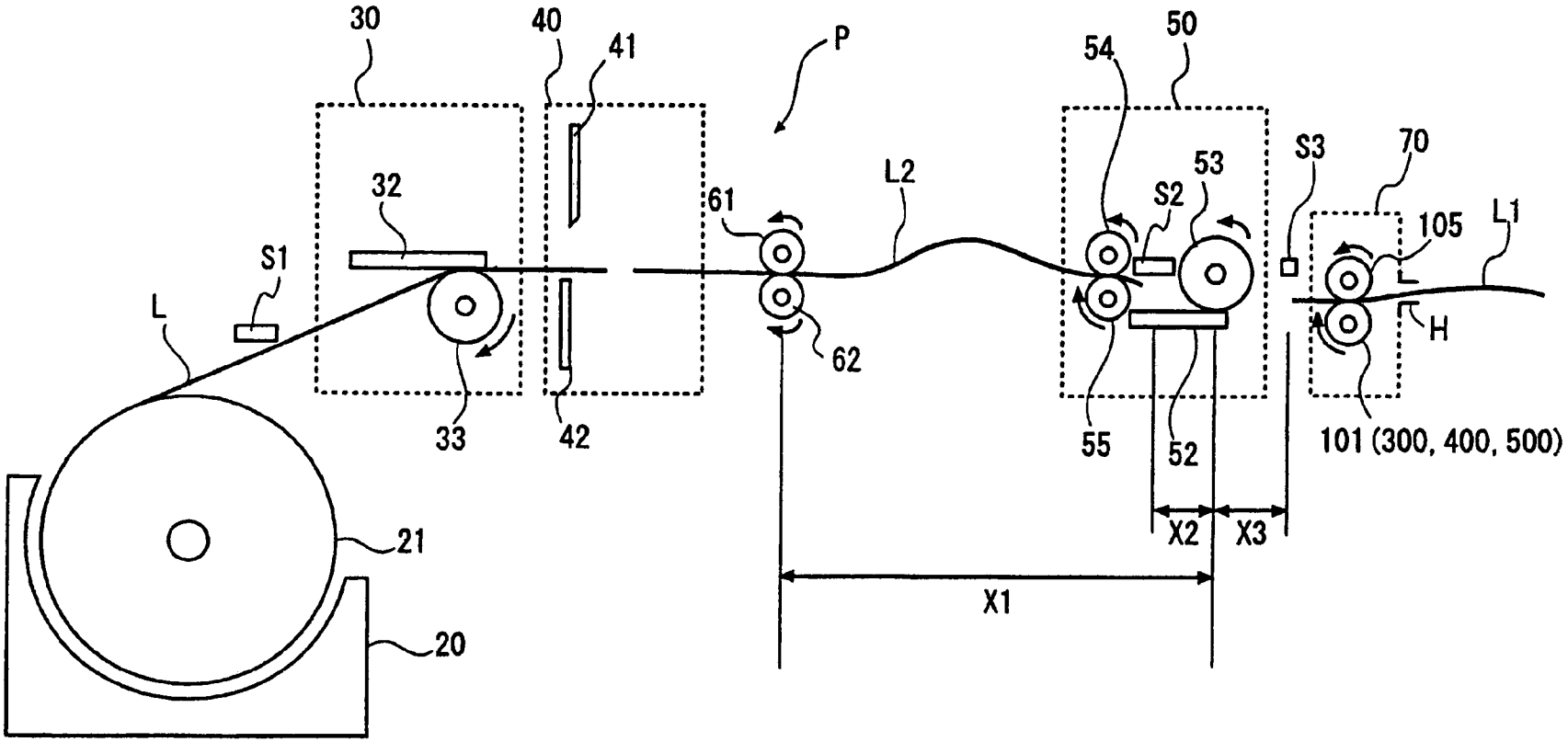
FIG. 1 is a schematic view showing a configuration of a thermal printer apparatus according to the invention.

FIG. 1 is a schematic view showing a configuration of a thermal printer apparatus P for heat-sensitive adhesive labels as a printer apparatus according to the invention.

The thermal printer apparatus P comprises a roll containing unit 20 for holding heat-sensitive adhesive labels 21 in the form of a tape wound like a roll, a printing unit 30 for performing printing on a heat-sensitive adhesive label L which has been pulled out, a cutter unit 40 for cutting the heat-sensitive adhesive label L into labels (L1 and L2) having a predetermined length, a thermal activation unit 50 for thermally activating a heat-sensitive adhesive layer of the heat-sensitive adhesive label L, conveying rollers 61, 62, 54, and 55 for conveying the cut heat-sensitive adhesive labels L1 and L2 to the thermal activation unit 50, and a label holding unit 70 for conveying the heat-sensitive adhesive label L1 thermally activated by the thermal activation unit 50 out of the same and holding it in a predetermined position, etc.

Although there is no limitation on the heat-sensitive adhesive label L used in the present embodiment, for example, it has a structure in which a heat-insulating layer and a heat-sensitive coloring layer (a printable layer) on a top side of a base material in the form of a label and in which a heat-sensitive adhesive layer is formed by applying a heat-sensitive adhesive to a bottom side and drying the same. The heat-sensitive adhesive layer is constituted by a heat-sensitive adhesive mainly composed of a thermoplastic resin, a solid plastic resin, or the like. The heat-sensitive adhesive label L may not have the heat-insulating layer and may have a protective layer or a color printed layer (a layer which has been printed in advance) provided on a surface of the heat-sensitive coloring layer.

The printing unit 30 comprises a thermal head 32 for printing having a plurality of heating elements constituted by a plurality of relatively small resistors disposed in the width direction thereof to allow dot printing, a platen roller 33 for printing which is urged against the thermal head 32 for printing, etc. The heating elements will not be described in detail because they are similar in configuration to those in a well-known printing head for a thermal printer that is formed by providing protective films of crystallized glass on the surface of a plurality of heating resistors formed on a ceramic substrate using a thin film technique.

The printing unit 30 also has a driving mechanism comprising a first stepping motor 710 (see FIG. 2) for rotating the platen roller 33 for printing, a gear transmission mechanism, etc, and the platen roller 33 for printing is rotated clockwise by the driving mechanism to convey a heat-sensitive adhesive label L to the right in the figure. It also has pressure means which is not shown comprising, for example, a coil spring, a plate spring or the like, and the platen roller 33 for printing is resiliently urged by the spring action of the pressure means toward the thermal head 32 for printing. At this time, the platen roller 33 for printing can be uniformly urged against the entire heat-sensitive adhesive label L in the width direction thereof by keeping the rotating shaft of the same in parallel with the direction in which the heaters are arranged.

A paper sensor S1 is provided in front of the thermal head 32 for printing, and the driving of the platen roller 33 for printing is controlled based on the detection of a heat-sensitive adhesive label L by the paper sensor S1. For example, a printing process is enabled when a heat-sensitive adhesive label L is detected by the paper sensor S1, and a process such as display of an error message is performed when the heat-sensitive adhesive label L is not detected by a paper sensor S2 which will be described later.

The cutter unit 40 is for cutting a heat-sensitive adhesive label L which has been printed by the printing unit 30 into an appropriate length, and it comprises a movable blade 41 operated by a cutter driving section 708 (see FIG. 2), a fixed blade 42 provided opposite to the movable blade 41, etc.

The thermal activation unit 50 comprises a thermal head 52 for thermal activation as heating means having heating elements, a platen roller 53 for thermal activation as conveying means for conveying a heat-sensitive adhesive label L, a pair of pull-in rollers 54 (driving) and 55 (driven) for pulling a heat-sensitive adhesive label L2 transported from the printing unit 30 into a gap between the thermal head 52 for thermal activation and the platen roller 53 for thermal activation, etc.

The thermal head 52 for thermal activation is similar in configuration to the thermal head 32 for printing in this embodiment. That is, it is similar in configuration to a well-known printing head for a thermal printer which is formed by providing a protective film of crystallized glass on the surface of a plurality of heating resistors formed on a ceramic substrate using a thin film technique. By using a thermal head 52 for thermal activation that is thus similar in configuration to the thermal head 32 for printing, a cost reduction can be achieved through use of common parts. However, the heating elements of the thermal head 52 for thermal activation are not required to be divided on a dot-by-dot basis as done for the heating elements of the head 32 for printing, and a continuous resistor may be used.

The thermal activation unit 50 has a driving mechanism comprising a second stepping motor 711 (see FIG. 2) for rotating the platen roller 53 for thermal activation and the pull-in roller 54, a gear transmission mechanism, etc., and the platen roller 53 for thermal activation and the pull-in roller 54 are rotated in the direction opposite to the platen roller 33 for printing (counterclockwise in FIG. 1) by the driving mechanism to convey a heat-sensitive adhesive label L to the right. The thermal activation unit 50 also has pressure means (e.g., a coil spring or a plate spring) for resiliently urging the platen roller 53 for thermal activation toward the thermal head 52 for thermal activation. At this time, the platen roller 53 for thermal activation can be urged into uniform contact with the entire heat-sensitive adhesive label L in the width direction thereof by keeping the rotating shaft of the same in parallel with the direction in which the heaters are arranged.

A paper sensor S2 is provided between the pull-in rollers 54 and 55 and the platen roller 53 for thermal activation, and rotation driving for the pull-in roller 54 and the platen roller 53 for thermal activation and the thermal activation process for the thermal head 52 for thermal activation is controlled based on a detection signal of a heat-sensitive adhesive label L from the paper sensor S2.

A configuration may be employed in which a guide unit for guiding a heat-sensitive adhesive label L from the cutter unit 40 to the thermal activation unit 50 is provided.

Further, the thermal printer apparatus P of the present embodiment has ejection rollers 61 (driving) and 62 (driven) provided in contact with each other downstream of the cutter unit 40, and the ejection roller 61 is connected to the driving mechanism of the platen roller 33 for printing through a gear transmission mechanism. In the present embodiment, the ejection roller 62 as an auxiliary roller serves as urging means for sandwiching a heat-sensitive adhesive label L between the ejection roller 61 and itself. A plate-like member (a guide member or the like) may be used as urging member instead of the ejection roller 62 to sandwich and convey the heat-sensitive adhesive label L (L2) with the ejection roller 61 and the same.

The label holding unit 70 comprises an ejection roller 101 as a first rotating body which is driven for rotation in the conveying direction (which is clockwise in FIG. 1) with a circumferential surface thereof in contact with the heat-sensitive adhesive layer (the bottom surface in FIG. 1) of a heat-sensitive adhesive label L1 and a driven roller 105 as a contact member which is provided opposite to the circumferential surface of the ejection roller 101 with a gap equal to or smaller than the thickness of the heat-sensitive adhesive sheet L kept therebetween. The ejection roller 101 is connected to the above-described driving mechanism comprising the second stepping motor 711 (see FIG. 2), the gear transmission mechanism, etc. and coacts with the driven roller 105 to eject the adhesive sheet L out an ejection hole H of the thermal printer apparatus P.

The unit 70 is driven for clockwise rotation for a predetermined time under control of a CPU 700 (see FIG. 2) to sandwich and convey the heat-sensitive adhesive label L1 with the ejection roller 101 and the driven roller 105, and it is stopped at predetermined timing to hold the heat-sensitive adhesive label L1 in the state in which it is sandwiched between the ejection roller 101 and the driven roller 105. Since this allows a user to perform an applying operation by picking up the heat-sensitive adhesive label L1 held by the label holding unit 70 at desired timing, an advantage can be achieved in that convenience and user-friendliness can be improved because there is no operational restrictions such as picking up an ejected heat-sensitive adhesive label as soon as it arrives as in the prior art.

By setting the driving time of the ejection roller 101 such that the heat-sensitive adhesive label L1 comes to a position where the trailing end of the same does not remain on the thermal head 52 for thermal activation, the heat-sensitive adhesive label L1 can be held with the trailing end of the same spaced from the thermal head 52 for thermal activation, which makes it possible to avoid the problem of adhesion of part of the heat-sensitive adhesive onto the thermal head 52 for thermal activation. It is therefore possible to prevent the problem of smear or damage on the heat-sensitive adhesive layer of a subsequent heat-sensitive adhesive label L2 attributable to transfer of the adhesive that occurs when the heat-sensitive adhesive adheres to the surface of the thermal head 52 for thermal activation and the problem of reduction in the heating performance of the thermal head 52 for thermal activation attributable to alteration and burning of the adhesive that has adhered.

The conveying roller 101 may be formed of a material which is mainly composed of a substance having a relatively low surface energy such as a silicone resin or fluororesin. This makes it possible to prevent the adhesive of the heat-sensitive adhesive layer of the heat-sensitive adhesive label L1 from adhering to the surface of the conveying roller 101 with higher reliability.

A paper sensor 83 is disposed between the label holding unit 70 and the thermal activation unit 50, and the operations of the printing unit 30, the cutter unit 40, the thermal activation unit 50, and the label holding unit 70 can be controlled based on detection performed by the sensor S3 on whether the heat-sensitive adhesive label L1 is held by the label holding unit 70 or not.

Specifically, for example, when a detection signal from the paper sensor S3 continues a predetermined time, control can be performed such that the driving of the second stepping motor 711 is resumed to eject the entire heat-sensitive adhesive label L1 out of the apparatus (steps of the process will be described later using a flow chart). Since the entire heat-sensitive adhesive label L1 is thus ejected out of the apparatus when the retention of the heat-sensitive adhesive label L1 continues for the predetermined time (which is several tens seconds, for example), it is possible to automatically abandon the heat-sensitive adhesive label L1 which has become unusable because its heat-sensitive adhesive layer has become cool and lost adhesion.

For example, control may alternatively be performed such that the second stepping motor 711 is reversed and the heat-sensitive adhesive layer is reactivated by the thermal head 52 for thermal activation when the detection signal from the paper sensor S3 continues for a predetermined time (steps of the process will be described later using a flow chart). Thus, when the retention of the heat-sensitive adhesive label L1 continues for the predetermined time (which is several tens seconds, for example), the heat-sensitive adhesive layer of the heat-sensitive adhesive label L1 is automatically re-heated to restore adhesion. Control may alternatively be performed such that the driving of the first stepping motor 710 is stopped to stop printing on a subsequent heat-sensitive adhesive label L when the detection with the paper sensor S3 is on (or when the heat-sensitive adhesive label L1 is held by the label holding unit 70) and such that the first stepping motor 710 is driven to resume printing on the subsequent heat-sensitive adhesive label L when the detection with the paper sensor S3 is off (when the heat-sensitive adhesive label L1 is not held by the label holding unit 70) (steps of the process will be described later using a flow chart).

A control system of the thermal printer P will now be described with reference to FIG. 2.

Figure 2:
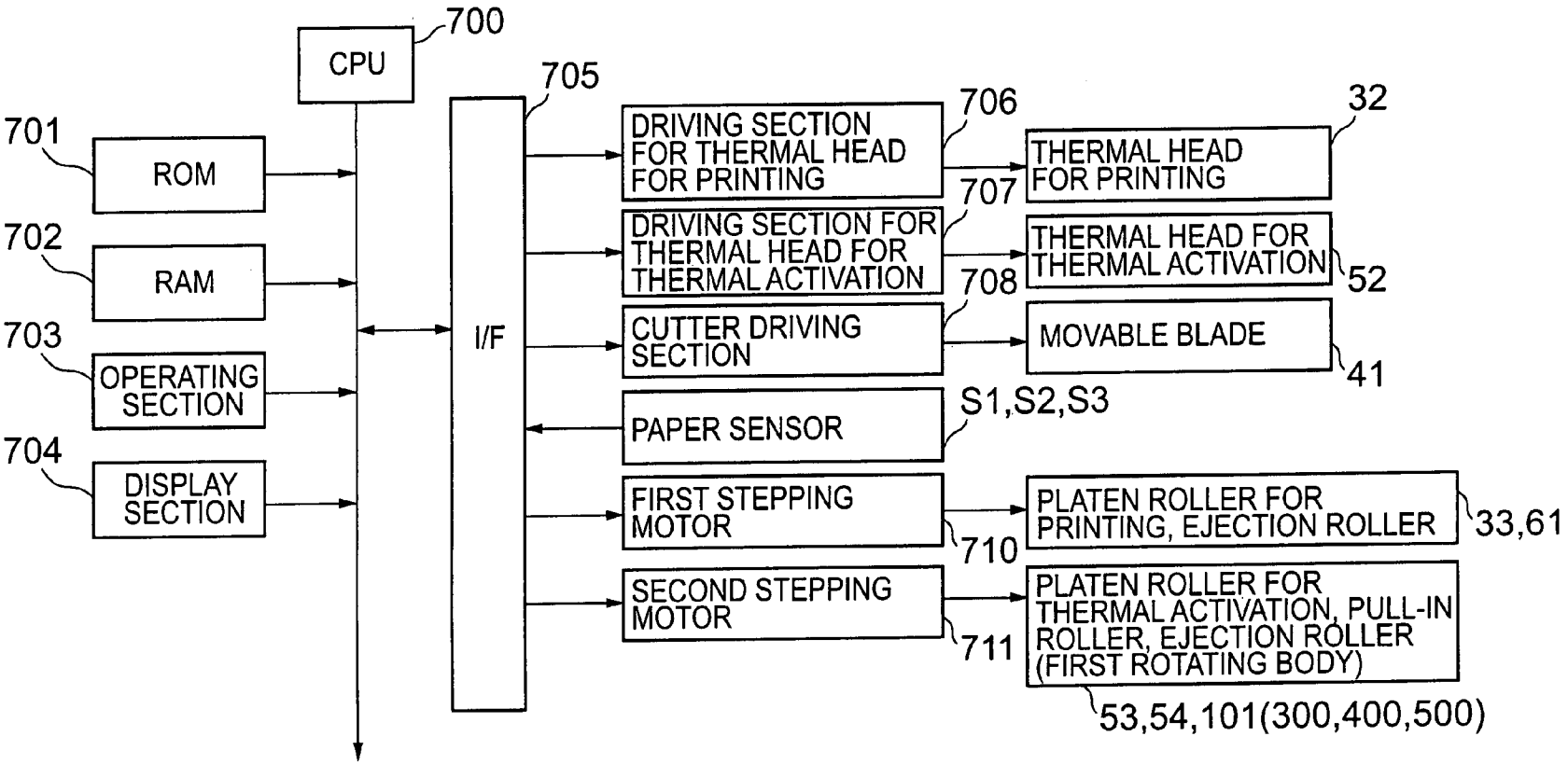
FIG. 2 is a control block diagram of the thermal printer apparatus according to the invention.

FIG. 2 is a control block diagram of the thermal printer P.

A control section of the thermal printer apparatus P comprises a CPU 700 as a controller for supervising the control section, a ROM 701 for storing a control program and the like executed by the CPU 700, a RAM 702 for storing various printing formats and the like, an operating section 703 for inputting, setting or retrieving printing data, printing format data, and the like, a display section 704 for displaying printing data and the like, an interface 705 for inputting and outputting data between the control section and driven sections, a driving circuit 706 for driving the thermal head 32 for printing, a driving circuit 707 for driving the thermal head 52 for thermal activation, a driving circuit 708 for driving the movable blade 41 for cutting a heat-sensitive adhesive label L, the paper sensors S1 and S2 for detecting a heat-sensitive adhesive label, the first stepping motor 710 for driving the platen roller 33 for printing and the ejection roller 61, the second stepping motor 711 for driving the platen roller 53 for thermal activation and the pull-in roller 54, etc.

Based on control signals transmitted from the CPU 700, the printing unit 30 performs printing as desired; the cutter unit. 40 performs a cutting operation at predetermined timing; and the thermal activation unit 50 performs activation of a heat-sensitive adhesive layer.

The CPU 700 is configured such that it can transmit independent control signals to the first stepping motor 710 and the second stepping motor 711, respectively.

This makes it possible to independently control the rotating speeds of the platen roller 33 for printing and the ejection roller 61 driven by the first stepping motor 710 and the platen roller 53 for thermal activation, the pull-in roller 54, and the ejection roller 101 driven by the second stepping motor 711, i.e., the conveying speeds of heat-sensitive adhesive labels L1 and L2.

An embodiment of the label holding unit will now be described with reference to FIGS. 3 to 10.

Figure 3A:
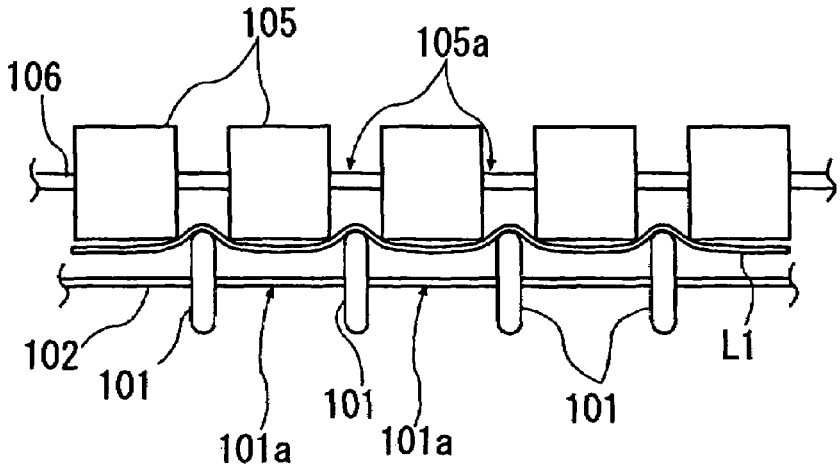
FIGS. 3A–3C are illustrations showing a first embodiment of a label holding unit which constitutes a major part of the thermal printer apparatus according to the invention.
Figure 3B:
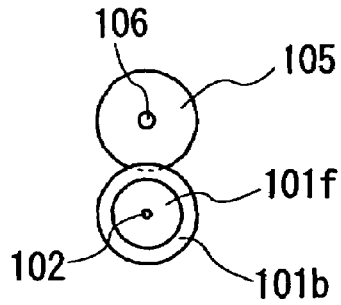
Figure 3C:
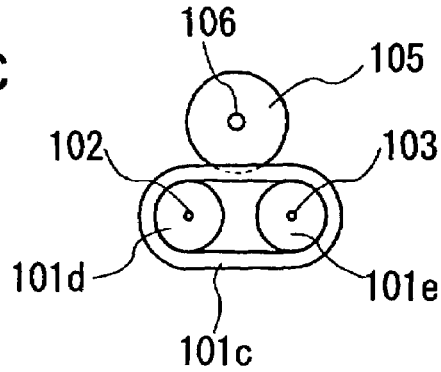

FIGS. 3A to 3C are schematic configuration diagrams showing a first embodiment of the label holding unit.

As shown in FIG. 3A, in the present embodiment, the contact member which contacts the printing surface of the heat-sensitive adhesive label L comprises a plurality of (five in FIG. 3A) roller members 105 securely provided at predetermined intervals 105*a* in the width direction of a rotating shaft 106.

The first rotating body which contacts the heat-sensitive adhesive layer of the heat-sensitive adhesive label L1 comprises a plurality of (four in FIG. 3A) wheel-like roller members 101 securely provided at predetermined intervals 101*a* in the width direction of a rotating shaft 102 which is disposed in parallel with the rotating shaft 106. The rotating shaft 102 is connected to the driving system including the second stepping motor 711.

The intervals 105*a* and the intervals 101*a* are set greater than the width of the wheel-like roller members 101 and the roller members 105, respectively, to provide a configuration in which each of the rollers stays within the interval 105*a* or 101*a* opposite thereto.

The distance between the rotating shaft 102 and the rotating shaft 106 is set slightly smaller than the sum of the radius of the roller members 105 and the radius of the wheel-like roller members 101. Thus, as shown in FIG. 3A, the heat-sensitive adhesive label L1 is sandwiched by the roller members 105 and the wheel-like roller members 101 such that the heat-sensitive adhesive label L1 takes the form of waves because of its viscosity, which makes it possible to generate a frictional force that is optimal for conveying or holding the same.

The wheel-like roller members 101 may be formed of a material which is mainly composed of a substance having a relatively low surface energy such as a silicone resin or fluororesin to prevent the adhesive of the heat-sensitive adhesive layer of the heat-sensitive adhesive label L1 in contact with the members from adhering to them.

As shown in FIG. 3B, the wheel-like roller members 101 may comprise a disk-like member 101*f* and an O-ring 101*b* fitted to the outer circumference of the same. In this case, the O-ring 101*b* may be formed of a material which is mainly composed of a substance having a relatively low surface energy such as a silicone resin or fluororesin to prevent the adhesive of the heat-sensitive adhesive layer of the heat-sensitive adhesive label L1 in contact with the members from adhering to them.

A configuration may be employed in which endless belts 101*c* as shown in FIG. 3C are used instead of the wheel-like roller members 101. Specifically, a configuration is provided in which two rotating shafts 102 and 103 which can rotate in the conveying direction are provided side by side perpendicularly to the conveying direction; a plurality of wheel-like roller members 101*d* and 101*e* are securely provided at predetermined intervals in the axial direction of the rotating shafts 102 and 103, respectively; an endless belt 101*c* is wound around each of the series of rollers arranged in the conveying direction; and either of the rotating shafts 102 and 103 is connected to the driving system including the second stepping motor 711. In this case, the endless belts 101*c* may be formed of a material which is mainly composed of a substance having a relatively low surface energy such as a silicone resin or fluororesin to prevent the adhesive of the heat-sensitive adhesive layer of a heat-sensitive adhesive label L1 in contact with the members from adhering to them. Thus, the heat-sensitive adhesive label L1 is sandwiched by the roller members 105 and the endless belts 101*c* having a contact portion which is relatively long in the conveying direction, and this allows the label to be more reliably conveyed and held.

A second embodiment of the label holding unit will now be described with reference to FIGS. 4A and 4B.

Members similar to those in the first embodiment will be indicated like reference numerals and will not be described in detail.

Figure 4A:
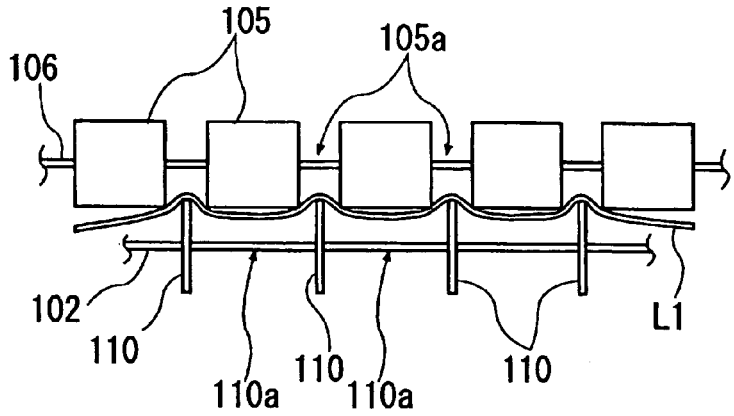
FIGS. 4A–4B are illustrations showing a second embodiment of the label holding unit which constitutes a major part of the thermal printer apparatus according to the invention.

As shown in FIG. 4A, in the present embodiment, the contact member which contacts the printing surface of the heat-sensitive adhesive label L comprises a plurality of (five in FIG. 4A) roller members 105 securely provided at predetermined intervals 105*a* in the width direction of a rotating shaft 106.

The first rotating body which contacts the heat-sensitive adhesive layer of the heat-sensitive adhesive label L1 comprises a plurality of (four in FIG. 4A) wheel-like roller members 110 securely provided at predetermined intervals 110*a* in the width direction of a rotating shaft 102 which is disposed in parallel with the rotating shaft 106. The rotating shaft 102 is connected to the driving system including the second stepping motor 711.

Figure 4B:
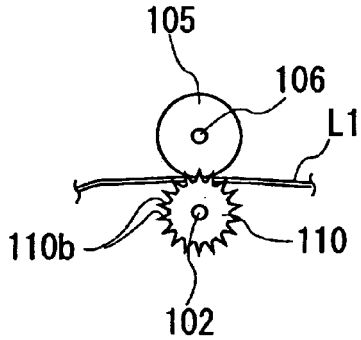

As shown in FIG. 4B, the wheel-like roller members 110 are formed with a plurality of radial protrusions 110*b* at an outer circumferential section thereof. This makes it possible to reduce the area of contact between the heat-sensitive adhesive layer of the heat-sensitive adhesive label L1 and the wheel-like roller members 110 and to reliably prevent the adhesive from adhering to circumferential surfaces of the wheel-like roller members 110.

A third embodiment of the label holding unit will now be described with reference to FIGS. 5A and 5B.

Figure 5A:
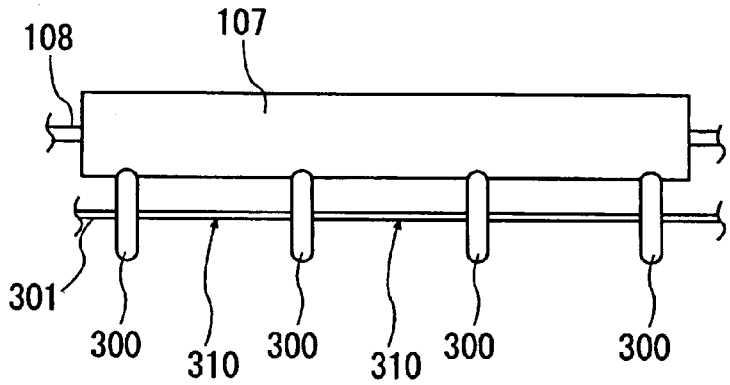
FIGS. 5A–5B are illustrations showing a third embodiment of the label holding unit which constitutes a major part of the thermal printer apparatus according to the invention.

As shown in FIG. 5A, in the present embodiment, the contact member which contacts the printing surface of the heat-sensitive adhesive label L1 comprises a roller member 107 securely provided on a rotating shaft 108.

Figure 5B:
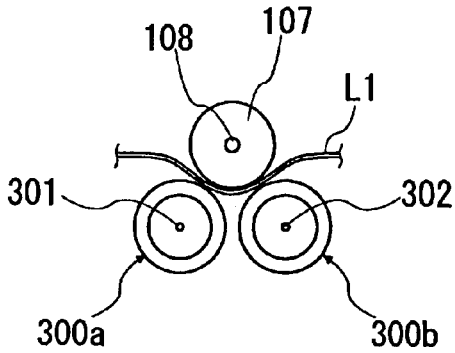

As shown in FIG. 5B, the first rotating body which contacts the heat-sensitive adhesive layer of the heat-sensitive adhesive label L1 is configured by providing two rotating shafts 301 and 302, which are in parallel with the rotating shaft 108 and which can rotate in the conveying direction, side by side perpendicularly to the conveying direction, securely providing a plurality of (four in FIG. 5B) wheel-like roller members 300*a* and 300*b* at intervals 310 in the axial direction of the rotating shafts 301 and 302, respectively, and connecting either of the rotating shafts 301 and 302 to the driving system including the second stepping motor 711.

The wheel-like roller members 300*a* and 300*b* may comprise an O-ring 101*b* fitted to the outer circumference thereof just as in the first embodiment. Thus, the heat-sensitive adhesive label L1 is sandwiched by the roller member 107 and the plurality of wheel-like roller members 300*a* and 300*b* provided side by side in the conveying direction, which allows conveyance and retention can be more reliably performed.

Figure 6A:
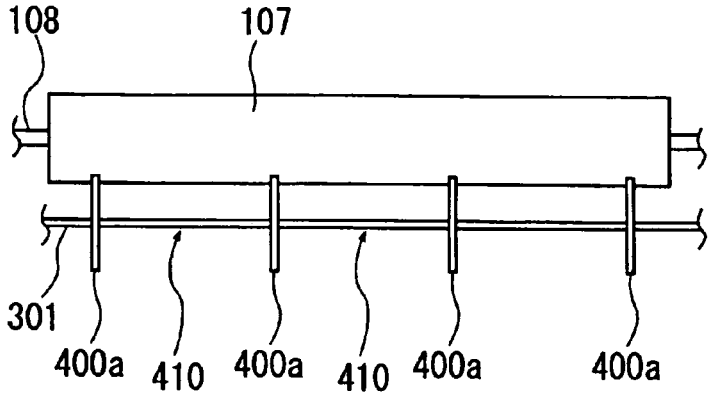
FIGS. 6A–6B are illustrations showing a fourth embodiment of the label holding unit which constitutes a major part of the thermal printer apparatus according to the invention.

A fourth embodiment of the label holding unit will now be described with reference to FIGS. 6A and 6B.

Features similar to those in the third embodiment will be indicated by like reference numerals and will not be described.

Figure 6B:
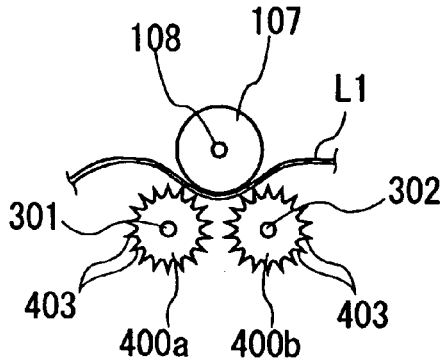

In the present embodiment, as shown in FIG. 6B, the first rotating body which contacts the heat-sensitive adhesive layer of the heat-sensitive adhesive label L1 is configured by providing two rotating shafts 301 and 302, which are in parallel with the rotating shaft 108 and which can rotate in the conveying direction, side by side perpendicularly to the conveying direction, securely providing a plurality of (four in FIG. 6B) wheel-like roller members 400*a* and 400*b* at intervals 410 in the axial direction of the rotating shafts 301 and 302, respectively, and connecting either of the rotating shafts 301 and 302 to the driving system including the second stepping motor 711.

As shown in FIG. 6B, the wheel-like roller members 400*a* and 400*b* are provided with radial protrusions 403 at the outer circumference thereof. Thus, the heat-sensitive adhesive label L1 is sandwiched by the roller member 107 and the plurality of wheel-like roller members 400*a* and 400*b* provided side by side in the conveying direction, which allows conveyance and retention can be more reliably performed. It is also possible to reduce the area of contact between the heat-sensitive adhesive layer of the heat-sensitive adhesive label L1 and the wheel-like roller members 400*a* and 400*b* and to reliably prevent the adhesive from adhering to circumferential surfaces of the wheel-like roller members 400*a* and 400*b*.

A fifth embodiment of the label holding unit will now be described with reference to FIGS. 7A and 7B.

Figure 7A:
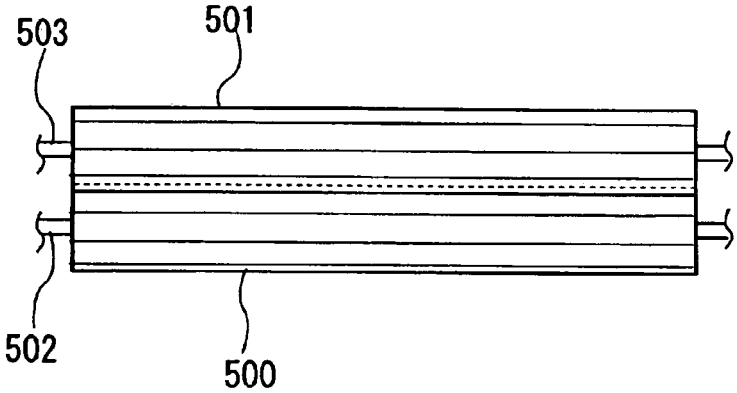
FIGS. 7A–7B are illustrations showing a fifth embodiment of the label holding unit which constitutes a major part of the thermal printer apparatus according to the invention.
Figure 7B:
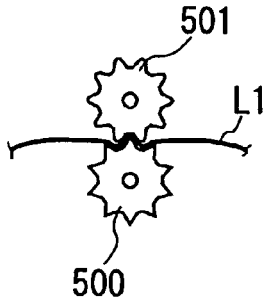

As shown in FIGS. 7A and 7B, in the present embodiment, the contact member which contacts the printing surface of the heat-sensitive adhesive label L1 comprises a roller member 501 securely provided on a rotating shaft 503. The roller member 501 has gearwheel-like (or star-like) sectional shape as shown in FIG. 7B.

As shown in FIGS. 7A and 7B, the first rotating body which contacts the heat-sensitive adhesive layer of the heat-sensitive adhesive label L1 comprises a roller member 500 securely provided on a rotating shaft 502 which is in parallel with the rotating shaft 503 and which can rotate in the conveying direction. The roller member 500 has a gearwheel-like (or star-like) sectional shape as shown in FIG. 7B.

Gearwheel-like grooves of the roller members 500 and 501 are rotatably engaged with each other as shown in FIG. 7B. At least either of the rotating shafts 502 and 503 is connected to the driving system including the second stepping motor 711.

Thus, the heat-sensitive adhesive layer of the heat-sensitive adhesive label L1 and the roller member 500 can be put in linear contact with each other to reduce the contact area and to reliably prevent the adhesive from adhering to an circumferential surface of the roller member 500. Since the heat-sensitive adhesive label L1 is sandwiched by the gearwheel-like grooves of the roller members 500 and 501 engaging each other, more reliable conveyance and retention can be performed.

Figure 8A:
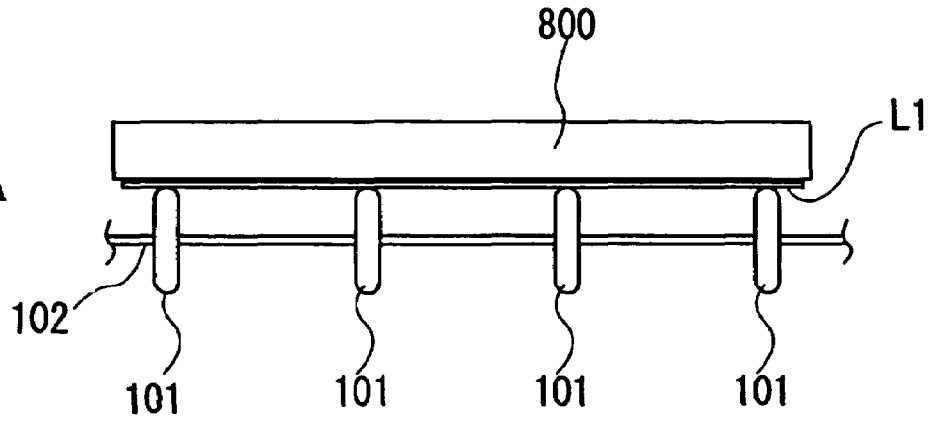
FIGS. 8A–8C are illustrations showing a sixth embodiment of the label holding unit which constitutes a major part of the thermal printer apparatus according to the invention.

A sixth embodiment of the label holding unit will now be described with reference to FIGS. 8A to 8C.

In the present embodiment, the contact member comprises a plate-like member 800 which is provided to extend in the width direction of the heat-sensitive adhesive label L1.

Figure 8B:
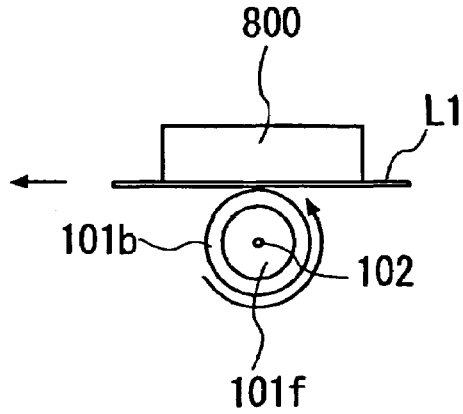
Figure 8C:
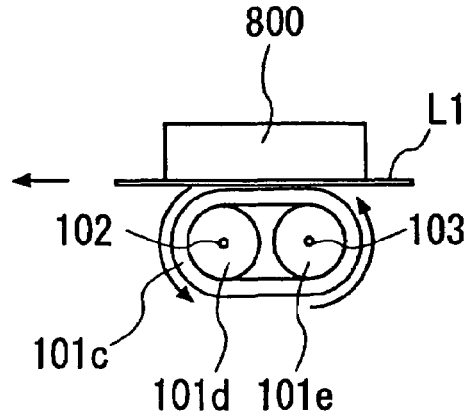

A configuration utilizing wheel-like roller members 101 and endless belts 101*c* as the first rotating body in the present embodiment is similar to that in the above-described first embodiment as shown in FIGS. 8B and 8C. Therefore, it is indicated by like reference numerals and will not be described in detail.

The distance between a contact surface of the plate-like member 800 and circumferential surfaces of the wheel-like roller members 101 and the endless belts 101*c* is desirably equal to or smaller than the thickness of the heat-sensitive adhesive label L1.

According to the present embodiment, the label holding unit 70 can be formed in a simpler configuration.

A seventh embodiment of the label holding unit will now be described with reference to FIGS. 9A to 9C.

In the present embodiment, the contact member comprises a plate-like member 900 which extends in the width direction of the heat-sensitive adhesive label L1 and which is formed with a plurality of (four locations in the present embodiment) comb-like grooves 900*a* having a width greater than the width of the first rotating body in the longitudinal direction.

Figure 9A:
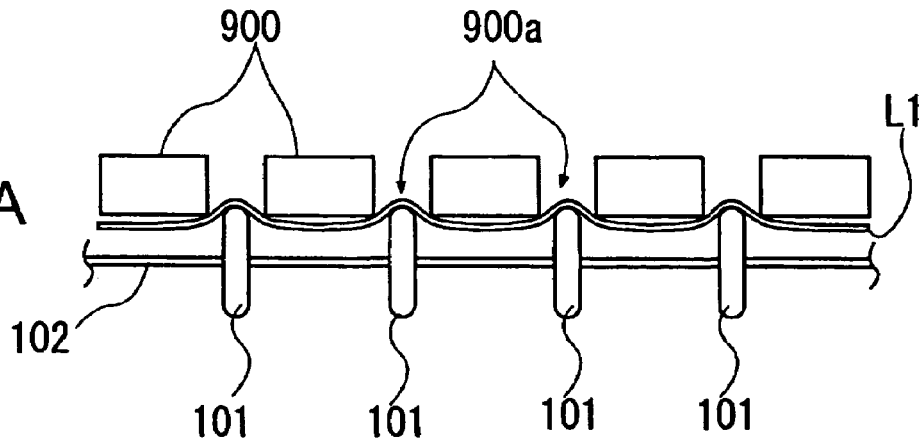
FIGS. 9A–9C are illustrations showing a seventh embodiment of the label holding unit which constitutes a major part of the thermal printer apparatus according to the invention.
Figure 9B:
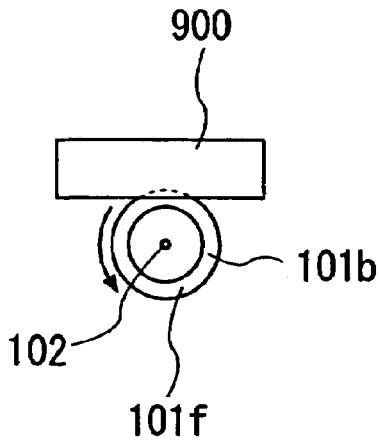
Figure 9C:
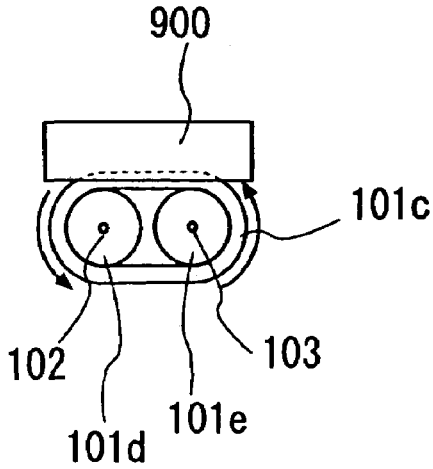

A configuration utilizing wheel-like roller members 101 and endless belts 101*c* as the first rotating body in the present embodiment is similar to that in the above-described first embodiment as shown in FIGS. 9B and 9C. Therefore, it is indicated by like reference numerals and will not be described in detail. The wheel-like roller members 101 or endless belts 101*c* are provided such that they are interposed in the respective grooves 900*a* of the plate-like member 900.

A configuration is employed in which the distance between rotating shafts 102 and 103 of the wheel-like roller members 101 and the endless belts 101*c* and a surface of the plate-member 900 opposite thereto is equal to or smaller than the length of the radius of the roller members 101 or 101*d*, 101*e*.

According to the present embodiment, the outer surface of the plate-like member 900 and the circumferential surfaces of the wheel-like roller members 101 or endless belts 101*c* will not contact when no heat-sensitive adhesive label L1 is held by the holding means. Therefore, even if the adhesive adheres to the circumferential surfaces of the wheel-like roller members 101 or endless belts 101*c*, it is prevented from being transferred to the plate-like member 900. It is therefore possible to avoid situations in which the printable surface of the heat-sensitive adhesive label L1 is smeared or damaged as a result of transfer of the adhesive through the plate-like member 900.

An adequate urging force is applied to the heat-sensitive adhesive label L1 from the wheel-like roller members 101 or the endless belts 101*c*, and the heat-sensitive adhesive label L1 is thus sandwiched in a wavy shape because of its viscosity as shown in FIG. 9A, which makes it possible to generate a frictional force that is optimal for conveying or holding the same.

In any case, a configuration may be employed in which the distance between the circumferential surfaces of the rotating bodies and the contact surface of the contact member (the circumferential surface in the case of a rotating body) is equal to or smaller than the thickness of the heat-sensitive adhesive label L1 in the condition that the rotating bodies or the contact member opposite thereto is under a pressure of its own weight or loaded with an auxiliary urging mechanism such as a spring.

An eighth embodiment of the label holding unit will now be described with reference to FIGS. 10A to 10C.

In the present embodiment, the contact member comprises a member 910 in the form of a plate spring which extends in the width direction of the heat-sensitive adhesive label L1. The member 910 in the form of a plate spring is formed with a plurality of (four locations in the present embodiment) comb-like grooves 910*a* having a width greater than the width of the first rotating body in the longitudinal direction just as in the seventh embodiment.

Figure 10A:
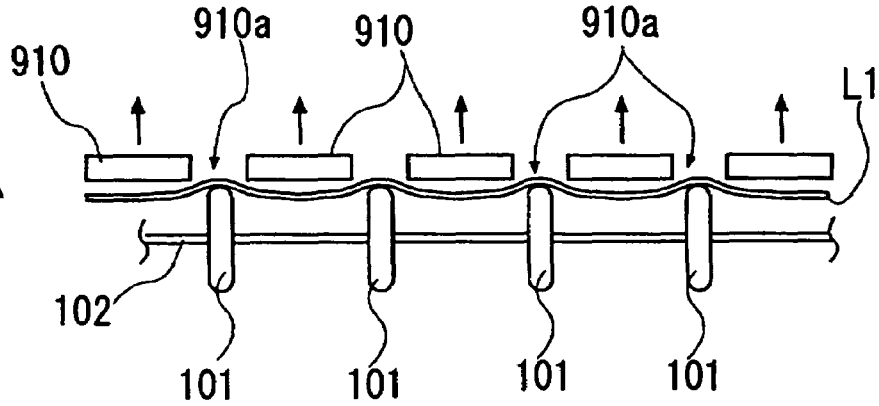
FIGS. 10A–10C are illustrations showing an eighth embodiment of the label holding unit which constitutes a major part of the thermal printer apparatus according to the invention.
Figure 10B:
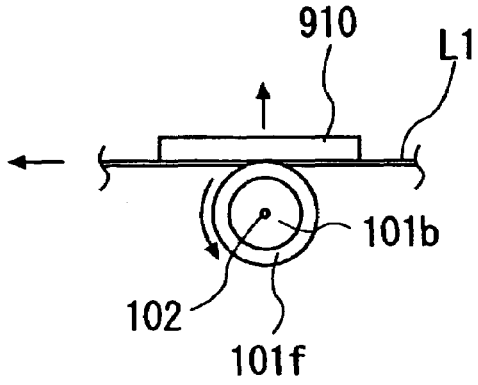
Figure 10C:
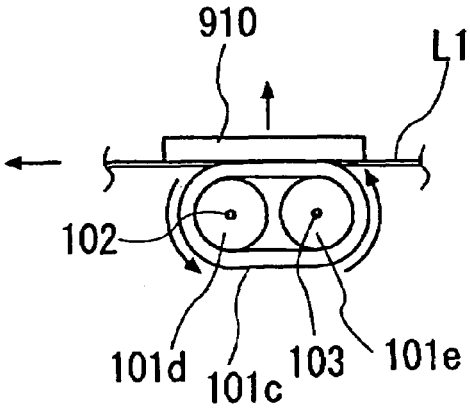

A configuration utilizing wheel-like roller members 101 and endless belts 101*c* as the first rotating body in the present embodiment is similar to that in the above-described first embodiment as shown in FIGS. 10B and 10C. Therefore, it is indicated by like reference numerals and will not be described in detail.

The wheel-like roller members 101 or endless belts 101*c* are provided such that they are interposed in the respective grooves 910*a* of the member 910 in the form of a plate spring.

A configuration is employed in which the distance between rotating shafts 102 and 103 of the wheel-like roller members 101 and the endless belts 101*c* and a surface of the member 910 in the form of a plate spring opposite thereto is equal to or smaller than the length of the radius of the roller members 101 or 101*d*, 101*e*.

According to the present embodiment, the outer surface of the member 910 in the form of a plate spring and the circumferential surfaces of the wheel-like roller members 101 or endless belts 101*c* will not contact when no heat-sensitive adhesive label L1 is held by the holding means. Therefore, even if the adhesive adheres to the circumferential surfaces of the wheel-like roller members 101 or endless belts 101*c*, it is prevented from being transferred to the member 910 in the form of a plate spring. It is therefore possible to avoid situations in which the printable surface of the heat-sensitive adhesive label L1 is smeared or damaged as a result of transfer of the adhesive through the member 910 in the form of a plate spring.

An adequate urging force is applied to the heat-sensitive adhesive label L1 from the member 910 in the form of a plate spring and the wheel-like roller members 101 or the endless belts 101*c*, and the heat-sensitive adhesive label L1 is thus sandwiched in a wavy shape because of its viscosity as shown in FIG. 10A, which makes it possible to generate a frictional force that is optimal for conveying or holding the same.

The member 910 in the form of a plate spring may comprise a plate spring made of metal, and it may alternatively comprise a film of plastic or the like.

Figure 11A:
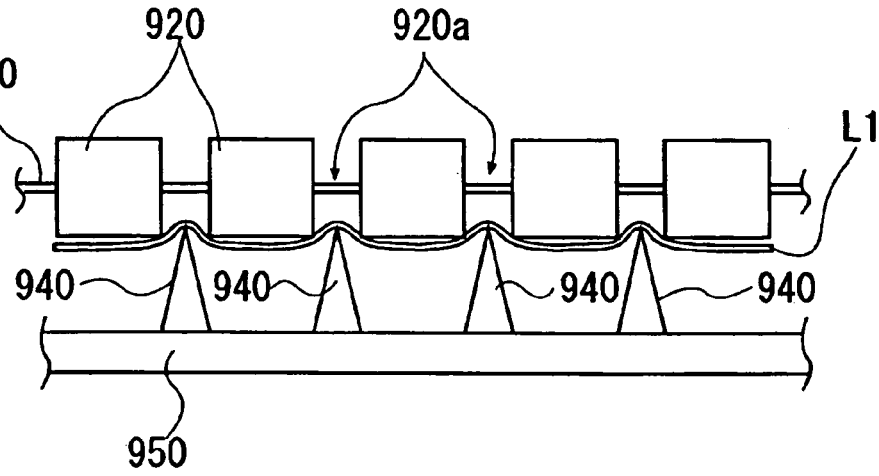
FIGS. 11A–11C are illustrations showing a modification of the label holding unit.
Figure 11B:
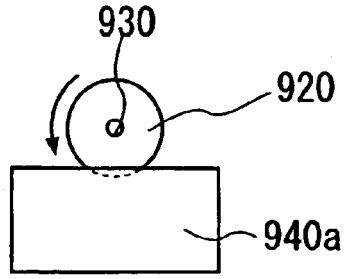
Figure 11C:
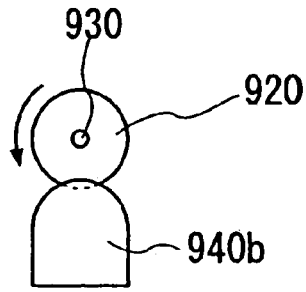

A modification of the label holding unit will now be described with reference to FIGS. 11A to 11C.

In this example, roller members 920 are used as the member which contacts the printable surface of the heat-sensitive adhesive label L1, and a plurality of protrusions 940 erected on a base 950 are used as the member which contacts the heat-sensitive adhesive layer instead of the first rotating body.

A plurality of (five in FIG. 11A) the roller members 920 are securely provided on a rotating shaft 930 connected to driving means rotated in the conveying direction, the members being at intervals 920*a* greater than the width of the ends of the protrusions 940.

The tips of the protrusions 940 are formed with a small width such that they contact the heat-sensitive adhesive layer of the heat-sensitive adhesive label L1 in a small contact area. A protrusion 940*a* shown in FIG. 11B and a protrusion 940*b* shown in FIG. 11C are examples of a type which is somewhat wide in the conveying direction and a type which is tapered at the end, respectively.

The protrusion 940*a* may be formed of a material which is mainly composed of a substance having a relatively low surface energy such as a silicone resin or fluororesin.

Thus, the label holding unit 70 can be formed in a simple configuration without using the first rotating body as in the above-described embodiments 1 to 8.

Processing steps of a control process in the thermal printer P will now be described with reference to the flow charts in FIGS. 12 to 14.

Figure 12:
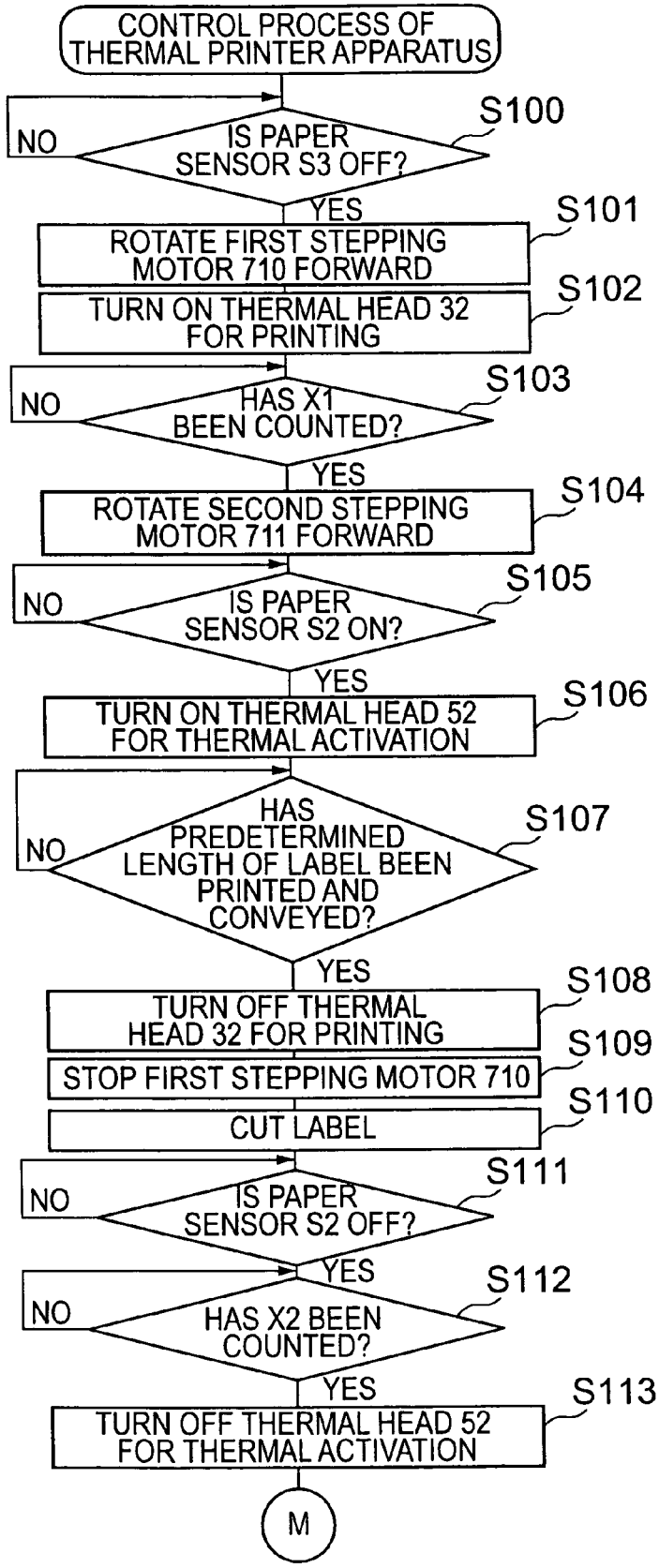
FIG. 12 is a flow chart showing processing steps of a control process of the thermal printer apparatus according to the invention.

In the flow chart in FIG. 12, when the control process is started, it is first determined at step S100 whether the paper sensor S3 is in the off-state or not. If the result of determination is No or if the paper sensor S3 is in the on-state and a heat-sensitive adhesive label L1 is held by the label holding unit 70, the same state is maintained. If the result of determination is Yes, it is determined that there is no heat-sensitive adhesive label L1 at the label holding unit 70, and the process proceeds to step S101.

At step S101, the first stepping motor 710 is turned on to rotate the platen roller 33 and the ejection roller 61 forward. Thus, the conveyance of the heat-sensitive adhesive label L in the printing unit 30 and the cutter unit 40 is started.

Next, at step S102, the thermal head 32 for printing is turned on to perform predetermined printing on the printable surface of the heat-sensitive adhesive label L.

The process then proceeds to step S103 at which it is determined whether a distance X1 (see FIG. 1) corresponding to the distance from the center of the ejection roller 61 to the center of the platen roller 53 for thermal activation has been counted or not. The counting is actually carried out by counting the number of revolutions of the first stepping motor 710 or the number of pulses applied. If the result of determination is No, the counting is continued, and the process proceeds to step S104 if the result of determination is Yes.

At step S104, the second stepping motor 711 is turned on to rotate the platen roller 53 for thermal activation, the pull-in roller 54, and the ejection roller (first rotating body) 101 (300, 400, 500) forward. Thus, the conveyance of the heat-sensitive adhesive label L (L2) in the thermal activation unit 50 and the label holding unit 70 is started.

Next, it is determined at step S105 whether the paper sensor S2 is in the on-state or not. If the result of determination is No, the same state is maintained. If the result of determination is Yes, the process proceeds to step S106 at which the thermal head 52 for thermal activation is turned on to start the thermal activation process on the heat-sensitive adhesive layer of the heat-sensitive adhesive label L2 that has arrived at the thermal activation unit 50.

The process then proceeds to step S107 at which the printing process and the conveying process have been completed for a predetermined length of the heat-sensitive adhesive label L2. In practice, the determination is made by counting the number of revolutions of the first stepping motor 710 and the second stepping motor 711 or the number of pulses applied. If the result of determination is No, the completion of the process is waited for. If the result of determination is Yes, the process proceeds to step S108 at which the thermal head 32 for printing is turned off. After the first stepping motor 710 is stopped at step S109, a cutter driving section 708 is turned on at step S110 to drive the movable blade 41, thereby cutting the trailing end of the heat-sensitive adhesive label L2.

The process then proceeds to step S111 at which it is determined whether the paper sensor S2 is in the off-state or not. If the result of determination is No, the driving of the second stepping motor 711 is continued as it is, and the process proceeds to step S112 if the result of determination is Yes.

It is determined at step S112 whether a distance X2 (see FIG. 1) corresponding to the distance from the center of the platen roller 53 for thermal activation to the center of paper sensor S2 has been counted or not. The counting is actually carried out by counting the number of revolutions of the second stepping motor 711 or the number of pulses applied. If the result of determination is No, the counting is continued and, if the result of determination is Yes, the process proceeds to step S113 at which the thermal head 52 for thermal activation is turned off. This ensures that the thermal activation process is performed up to the trailing end of the heat-sensitive adhesive label L2.

Figure 13:
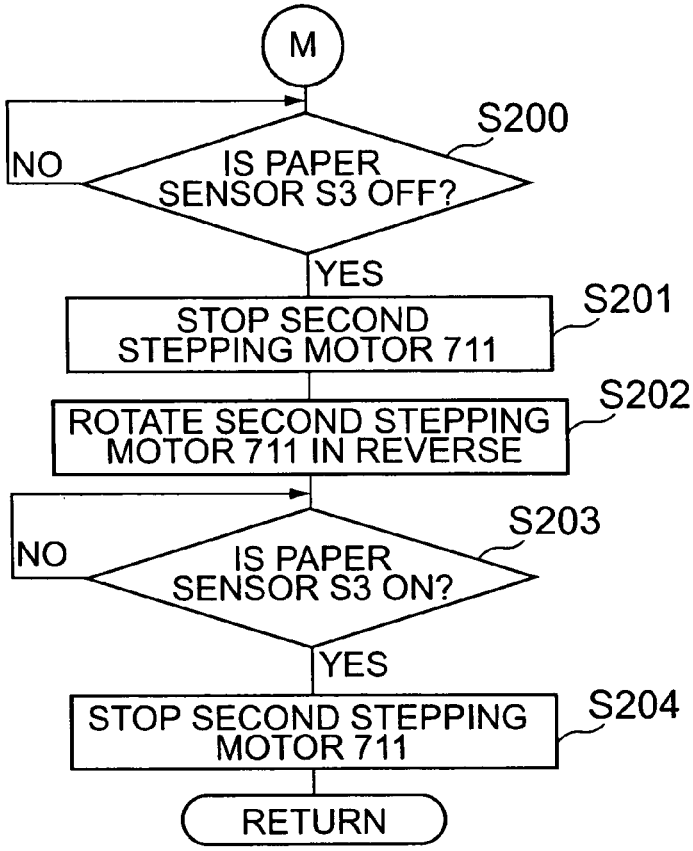
FIG. 13 is a flow chart showing processing steps of the control process of the label holding unit of the thermal printer apparatus according to the invention.

Then, a jump to the subroutine M shown in FIG. 13 occurs.

The subroutine M shown in the flow chart in FIG. 13 represents processing steps performed when control for holding the heat-sensitive adhesive label L1 (L2) with the label holding unit 70 is carried out using the paper sensor S3.

At step S200 of the process, it is determined whether the paper sensor S3 is in the off-state or not and, if the result of determination is No (or if the heat-sensitive adhesive label L1 (L2) has arrived and the paper sensor S3 is in the on-state), the driving of the second stepping motor 711 is continued as it is to continue conveyance with the ejection roller 101 (300, 400, 500). If the result of determination is Yes, the process proceeds to step S201 at which the second stepping motor 711 is stopped, and the process then proceeds to step S202.

At step S202, the second stepping motor 711 is rotated in reverse to reverse the conveyance with the ejection roller 101 (300, 400, 500). The process then proceeds to step S203 at which it is determined whether the paper sensor S3 is turned on again or not. If the result of determination is No, the reverse rotation of the second stepping motor 711 is continued. If the result of determination is Yes, the process proceeds to step S204 at which the second stepping motor 711 is stopped to terminate the series of processes, and the process returns to step S100 again.

The processes at steps S200 to S204 allow the heat-sensitive adhesive label L1 (L2) to be held by the label holding unit 70 with the trailing end of the heat-sensitive adhesive label L1 (L2) in a position apart from the thermal head 52 for thermal activation. Since this allows a user to perform an applying operation by picking up the heat-sensitive adhesive label L1 (L2) held by the label holding unit 70 at desired timing, convenience and user-friendliness can be improved because there is no operational restrictions such as picking up an ejected heat-sensitive adhesive label as soon as it arrives as in the prior art.

Since the heat-sensitive adhesive label L1 (L2) can be held with the trailing end of the same spaced from the thermal head 52 for thermal activation, it is possible to avoid the problem of adhesion of part of the heat-sensitive adhesive onto the thermal head. It is therefore possible to prevent the problem of smear or damage on the heat-sensitive adhesive layer of a subsequent heat-sensitive adhesive label because of transfer of the adhesive that occurs when the heat-sensitive adhesive adheres to the surface of the thermal head 52 for thermal activation and the problem of reduction in the heating performance of the thermal head 52 because of alteration and burning of the adhesive that has adhered.

Although the heat-sensitive adhesive labels L1 and L2 are shown in FIG. 1, they are shown to represent the state of conveyance of the heat-sensitive adhesive labels. According to the processing steps in FIGS. 12 and 13, the subsequent heat-sensitive adhesive label is on standby at the printing unit 30 in the state in which the heat-sensitive adhesive label L1 is held by the label holding unit 70. When the heat-sensitive adhesive label L1 is picked up from the label holding unit 70, the processing of the subsequent heat-sensitive adhesive label is started, and it will be conveyed in the state represented by the heat-sensitive adhesive label L2.

Figure 14:
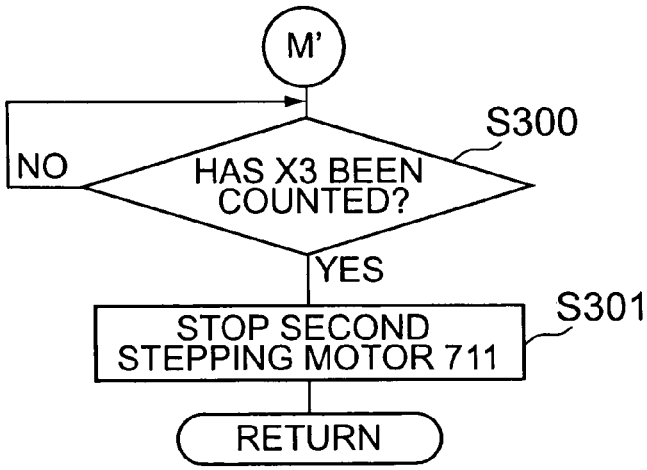
FIG. 14 is a flow chart showing processing steps of the control process of the label holding unit of the thermal printer apparatus according to the invention.

The subroutine M' shown in the flow chart in FIG. 14 represents processing steps performed when control for holding the heat-sensitive adhesive label L1 (L2) with the label holding unit 70 is carried out by counting the number of steps of the second stepping motor 711.

At step S300 of the process, it is determined whether a distance X3 from the center of the platen roller 53 for thermal activation to the paper sensor S3 has been counted or not. The distance X3 is actually counted by counting the number of steps of the second stepping motor 711. If the result of determination is No, the counting is continued. If Yes, the process proceeds to step S301 at which the second stepping motor 711 is stopped to terminate the series of processes, and the process returns to step S100 again.

The control process in the subroutine M' can provide the same advantages as those of the control process in the above-described subroutine M.

Although the invention made by the inventors has been specifically described above based on embodiments of the same, the invention is not limited to the above-described embodiments and may be modified in various ways without departing from the gist of the same.

For example, control may be performed such that the forward rotation of the second stepping motor 711 is resumed to eject the heat-sensitive adhesive label L1 (L2) out of the apparatus entirely when a detection signal from the paper sensor S3 continues for a predetermined time. As a result, since the entire heat-sensitive adhesive label L1 (L2) can be ejected out of the apparatus when retention continues for the predetermined time (which is several tens seconds, for example), it is possible to automatically abandon the heat-sensitive adhesive label L1 (L2) which has become unusable because the heat-sensitive adhesive layer has cooled down and lost adhesion.

Further, control may be performed to reverse the second stepping motor 711 and to reactivate the heat-sensitive adhesive layer with the thermal head 52 for thermal activation when a detection signal from the paper sensor S3 continues for a predetermined time.

As a result, the heat-sensitive adhesive layer of the heat-sensitive adhesive label L1 (L2) can be automatically reactivated to restore adhesion when retention continues for the predetermined time (which is several tens seconds, for example).

Although the stepping motor for driving the label holding unit 70 has been described as serving also as the stepping motor for the thermal activation unit 50 in the above-described embodiments 1 to 8, no problem will occur when a system is employed in which the stepping motor for driving the label holding unit 70 is independently controlled.

As described above, a printer apparatus according to the invention is a printer apparatus having at least a thermal head for printing which performs printing in contact with a heat-sensitive coloring layer of a heat-sensitive adhesive sheet having a printable surface constituted by the heat-sensitive coloring layer and a heat-sensitive adhesive layer formed on one and another side of a sheet-like base material, respectively, a thermal head for activation which heats the heat-sensitive adhesive layer to activate the same, conveying means which conveys the heat-sensitive adhesive sheet in a predetermined direction, and an ejection hole for ejecting the heat-sensitive adhesive sheet out of the apparatus. It has sheet holding means which spaces a trailing end of the heat-sensitive adhesive sheet which has been subjected to the printing process by the thermal head for printing and the activation process by the thermal head for activation from the thermal head for activation and which holds the sheet with part of the same exposed to the outside from the ejection hole. Since this allows a user to perform an applying operation by picking up the heat-sensitive adhesive sheet held by the sheet holding means at desired timing, convenience and user-friendliness can be improved because there is no operational restrictions such as picking up an ejected heat-sensitive adhesive sheet as soon as it arrives as in the prior art.

Since a sheet can be held with the trailing end of the same spaced from the thermal head for activation, it is possible to avoid the problem of adhesion of part of the heat-sensitive adhesive onto the thermal head. It is therefore possible to prevent the problem of smear or damage on the heat-sensitive adhesive layer of a subsequent heat-sensitive adhesive sheet because of transfer of the adhesive that occurs when the heat-sensitive adhesive adheres to the surface of the thermal head for thermal activation and the problem of reduction in the heating performance of the thermal head because of alteration and burning of the adhesive that has adhered.

What is claimed is:

1. A printer apparatus comprising:

a thermal head for printing which performs printing in contact with a heat-sensitive coloring layer of a heat-sensitive adhesive sheet having a printable surface constituted by the heat-sensitive coloring layer and a heat-sensitive adhesive layer formed on opposite sides of a sheet-like base material, respectively;

a thermal head for activation which heats the heat-sensitive adhesive layer to activate the same and which includes conveying means for conveying the heat-sensitive adhesive sheet in a predetermined direction;

means defining an ejection hole for ejecting the heat-sensitive adhesive sheet out of the apparatus; and sheet holding means for spacing a trailing end of the heat-sensitive adhesive sheet which has been subjected to the printing process by the thermal head for printing and the activation process by the thermal head for activation from the thermal head for activation and for holding the sheet with part of the same exposed to the outside from the ejection hole, the sheet holding means comprising a first rotating body which is driven for rotation in the conveying direction with a circumferential surface thereof in contact with the heat-sensitive adhesive layer, a contact member disposed opposite to the circumferential surface of the rotating body with a gap equal to or smaller than the thickness of the heat-sensitive adhesive sheet left therebetween, driving means for rotationally driving the rotating body, and control means for controlling the driving means such that the heat-sensitive adhesive sheet conveyed through the thermal head for activation is sandwiched between the circumferential surface of the rotating body and the contact member and conveyed a predetermined distance with the conveying means so as to space the trailing end of the sheet from the thermal head for activation and such that the rotation of the rotating body is stopped with part of the sheet exposed to the outside from the ejection hole.

2. A printer apparatus according to claim 1; wherein the contact member comprises a second rotating body which is disposed in the width direction of the heat-sensitive adhesive sheet and which contacts the printable surface.

3. A printing apparatus according to claim 1; wherein the first and second rotating bodies comprise a plurality of rollers securely provided at predetermined intervals in the axial direction of rotating shafts which can rotate in the conveying direction.

4. A printer apparatus according to claim 3; wherein the first rotating body comprises a wheel-like roller.

5. A printer apparatus according to claim 3; wherein the first and second rotating bodies are alternately disposed such that their circumferential surfaces do not face each other.

6. A printer apparatus according to claim 5; wherein the distance between the rotating shaft of the first rotating body and the rotating shaft of the second rotating body is equal to or smaller than the sum of the radius of the first rotating body and the radius of the second rotating body.

7. A printer apparatus according to claim 6; wherein both or either of the first rotating body and the second rotating body is urged against an opposite portion by the weight of itself or by urging means.

8. A printer apparatus according to claim 3; wherein at least a surface of each roller is formed of a material which is mainly composed of a substance having a relatively low surface energy such as a silicone resin or fluororesin.

9. A printer apparatus according to claim 3; wherein each roller has an O-ring attached to a circumferential surface thereof, the O-ring being formed of a material which is mainly composed of a substance having a relatively low surface energy such as a silicone resin or fluororesin.

10. A printer apparatus according to claim 1; wherein the first rotating body comprises two or more rotating shafts, which can rotate in the conveying direction, disposed side by side, and a plurality of wheel-like rollers connected to each of the rotating shafts at predetermined intervals in the axial direction of each of the rotating shafts, at least one of the rotating shafts being connected to be driven by a driving force transmitted thereto by the driving means.

11. A printer apparatus according to claim 1; wherein the first rotating body comprises two or more rotating shafts, which can rotate in the conveying direction, disposed side by side, a plurality of wheel-like rollers connected to each of the rotating shafts at predetermined intervals in the axial direction of each of the rotating shafts, and an endless belt wound around each of the series of rollers arranged in the conveying direction, at least one of the rotating shafts being connected to be driven by a driving force transmitted thereto by the driving means.

12. A printer apparatus according to claim 11; wherein the endless belt is formed of a material which is mainly composed of a substance having a relatively low surface energy such as a silicone resin or fluororesin.

13. A printer apparatus according to claim 1; wherein the contact member comprises a plate-like member that extends in the width direction of the heat-sensitive adhesive sheet.

14. A printer apparatus according to claim 13; wherein the contact member has comb-like grooves having a width greater than the width of the first rotating body in the longitudinal direction; and the first rotating body is interposed in each of the comb-like grooves such that the distance between the rotating shaft of the first rotating body and a surface of the contact member opposite thereto is equal to or smaller than the length of the radius of the first rotating body.

15. A printer apparatus according to claim 1; wherein the contact member comprises a plate spring that extends in the width direction of the heat-sensitive adhesive sheet.

16. A printer apparatus according to claim 1; wherein a plurality of protrusions are formed on a circumferential surface of the first rotating body.

17. A printer apparatus according to claim 16; wherein the protrusions are formed such that the first rotating body has a star-like or gearwheel-like sectional shape.

18. A printer apparatus according to claim 1; further comprising detection means for detecting the presence or absence of the heat-sensitive adhesive sheet in the vicinity of the ejection hole, wherein when a detection signal from the detection means continues for a predetermined time, the driving of the driving means is resumed to eject the heat-sensitive adhesive sheet out of the apparatus entirely.

19. A printer apparatus according to claim 1; further comprising detection means for detecting the presence or absence of the heat-sensitive adhesive sheet in the vicinity of the ejection hole, wherein when a detection signal from the detection means continues for a predetermined time, the driving means is reversed, and the heat-sensitive adhesive layer is reactivated by the thermal head for activation.

20. A printer apparatus comprising:

a thermal head for printing which performs printing in contact with a heat-sensitive coloring layer of a heat-sensitive adhesive sheet having a printable surface constituted by the heat-sensitive coloring layer and a heat-sensitive adhesive layer formed on opposite sides of a sheet-like base material, respectively;

a thermal head for activation which heats the heat-sensitive adhesive layer to activate the same and which includes conveying means for conveying the heat-sensitive adhesive sheet in a predetermined direction;

means defining an ejection hole for ejecting the heat-sensitive adhesive sheet out of the apparatus; and sheet holding means for spacing a trailing end of the heat-sensitive adhesive sheet which has been subjected to the printing process by the thermal head for printing and the activation process by the thermal head for activation from the thermal head for activation and for holding the sheet with part of the same exposed to the outside from the ejection hole, the sheet holding means comprising a contact member which is put in contact with the heat-sensitive adhesive layer at a leading end face thereof, a rotating body which is provided so as to face the leading end face of the contact member at a circumferential surface thereof with a gap equal to or smaller than the thickness of the heat-sensitive adhesive sheet left therebetween and which is driven for rotation in the conveying direction, driving means for rotationally driving the rotating body, and control means for controlling the driving means such that the heat-sensitive adhesive sheet conveyed through the thermal head for activation is sandwiched between the circumferential surface of the rotating body and the contact member and conveyed a predetermined distance with the conveying means so as to space the trailing end of the sheet from the thermal head for activation and such that the rotation of the rotating body is stopped with part of the sheet exposed to the outside from the ejection hole.

21. A printer apparatus according to claim 20; wherein at least a surface layer of the contact member is formed of a material which is mainly composed of a substance having a relatively low surface energy such as a silicone resin or fluororesin.

22. A printer apparatus according to claim 20; wherein the contact member is formed with comb-like grooves having a width greater than the width of the rotating body in the longitudinal direction; and the rotating body is interposed in each of the comb-like grooves such that the distance between the rotating shaft of the rotating body and a surface of the contact member opposite thereto is equal to or smaller than the length of the radius of the rotating body.

23. A printer apparatus according to claim 22; wherein both or either of the contact member and the rotating body is urged by the weight of itself or by urging means.

24. A printer apparatus according to claim 20; wherein at least a leading end face of a contact portion of the contact member is formed of a material which is mainly composed of a substance having a relatively low surface energy such as a silicone resin or fluororesin.

* * * * *